US008153177B2

(12) United States Patent
Sotile

(10) Patent No.: US 8,153,177 B2
(45) Date of Patent: Apr. 10, 2012

(54) ICE CREAM CONE HOLDER

(76) Inventor: Robert C. Sotile, Rochester, NY (US)

( * ) Notice: Subject to any disclaimer, the term of this patent is extended or adjusted under 35 U.S.C. 154(b) by 1145 days.

(21) Appl. No.: 11/219,631

(22) Filed: Sep. 2, 2005

(65) Prior Publication Data

US 2007/0054019 A1 Mar. 8, 2007

(51) Int. Cl.
*A22C 13/00* (2006.01)

(52) U.S. Cl. ..... 426/115; 426/132; 426/421; 426/394; 206/499; 206/506; 206/507; D1/105

(58) Field of Classification Search ..... 426/91, 426/95, 101, 132, 134, 139, 86, 90, 115, 426/130, 135, 389, 420, 421, 394; D1/102–105, D1/116–119; 206/514, 519, 499, 503, 505, 206/506, 507, 515, 516, 520
See application file for complete search history.

(56) References Cited

U.S. PATENT DOCUMENTS 1,326,520 A * 12/1919 McLaren ..... 426/128
1,367,848 A * 2/1921 Winnie ..... 426/139
1,532,806 A * 4/1925 Gerber ..... 426/139
1,584,653 A * 5/1926 Roberts ..... 426/139
1,607,664 A * 11/1926 Carpenter ..... 426/139
1,783,799 A * 12/1930 Kohr ..... 99/383
1,800,759 A * 4/1931 Shean ..... 426/135
1,829,201 A * 10/1931 Turnbull ..... 426/139
1,854,091 A * 4/1932 Young ..... 426/135
1,876,105 A * 9/1932 Turnbull ..... 426/94
1,894,545 A * 1/1933 Schoenfeld ..... 426/139
1,914,894 A * 6/1933 Moskowitz ..... 426/139
1,937,402 A * 11/1933 Cherry ..... 206/519
2,033,673 A * 3/1936 Balton ..... 426/139
2,087,068 A * 7/1937 Pape ..... 426/139
2,114,205 A * 4/1938 Balton ..... 426/139
2,447,045 A * 8/1948 Amberg ..... 426/139
2,667,423 A * 1/1954 Simpson ..... 426/86
2,784,097 A * 3/1957 Heyman ..... 426/139
2,845,209 A * 7/1958 Bruun ..... 229/4.5
2,948,452 A * 8/1960 Grogan et. al. ..... 426/132
2,980,039 A * 4/1961 Jolly ..... 249/97
2,988,258 A * 6/1961 Witzke ..... 229/400
3,085,730 A * 4/1963 Fibish ..... 229/400
3,342,370 A * 9/1967 Johnson ..... 206/520
3,347,411 A * 10/1967 Kalata et. al. ..... 206/519
3,353,707 A * 11/1967 Eyles ..... 206/519
3,379,340 A * 4/1968 Silvio ..... 206/509
3,401,862 A * 9/1968 Wanderer ..... 229/400
3,484,018 A * 12/1969 Davis ..... 206/520
3,931,890 A * 1/1976 Davis ..... 206/508
(Continued)

FOREIGN PATENT DOCUMENTS

CA 2135417 * 5/1996
(Continued)

*Primary Examiner* — Drew Becker
*Assistant Examiner* — Luana Z Long
(74) *Attorney, Agent, or Firm* — Shlesinger & Fitzsimmons

(57) ABSTRACT

An improved ice cream cone holder includes a conical portion with an open end and a closed end and at least one de-nesting formation about the open end to inhibit vacuum formation in stacks of the holders. Additionally, embodiments comprise at least one drainage formation at the open end to allow melt to enter the conical portion rather than to overflow a rim of a disc portion formed about the open end. Embodiments contemplate varying a distribution pattern of the drainage formations, the de-nesting formations, or both from holder to holder.

15 Claims, 7 Drawing Sheets

U.S. PATENT DOCUMENTS

| | | | | | |
|---|---|---|---|---|---|
| 5,224,646 | A | * | 7/1993 | Biancosino | 229/4.5 |
| 5,515,998 | A | * | 5/1996 | Wang | 220/710 |
| D382,085 | S | * | 8/1997 | Sotile | D1/105 |
| D391,036 | S | * | 2/1998 | Sotile | D1/105 |
| 6,032,825 | A | * | 3/2000 | Guthrie | 220/731 |
| 6,182,854 | B1 | * | 2/2001 | Jimenez et al. | 220/705 |
| 6,202,970 | B1 | * | 3/2001 | Dunbar | 248/311.3 |
| 6,375,236 | B1 | * | 4/2002 | Ducharme | 294/1.1 |
| 6,502,715 | B2 | * | 1/2003 | Miorelli | 220/719 |
| 6,571,979 | B2 | * | 6/2003 | Schmarr | 220/571 |
| 2005/0238762 | A1 | * | 10/2005 | De Los Santos | 426/90 |

FOREIGN PATENT DOCUMENTS

| | | | |
|---|---|---|---|
| FR | 2827584 | * | 1/2003 |
| GB | 2328366 | * | 2/1999 |
| WO | WO-98-10663 | * | 3/1998 |
| WO | WO-99-29181 | * | 6/1999 |
| ZA | 9906470 | * | 8/2000 |

* cited by examiner

ICE CREAM CONE HOLDER

CROSS-REFERENCE TO RELATED APPLICATIONS

This application is related to U.S. Design Pat. Nos. D382,085 and D391,036, as well as to U.S. patent application Ser. No. 11/211,008 filed on 24 Aug. 2005, which are incorporated herein by reference in their entireties.

BACKGROUND AND SUMMARY

Ice cream cones are very popular as holders for ice cream and serve as an extra treat for the purchaser of the ice cream the cones hold. There are many different types of cones, the most popular being frustroconical wafer cones, conical sugar cones, and conical waffle cones. The frustroconical wafer cones have flat, circular bottoms and steep side walls that often make the body portion of the cones look cylindrical. The sugar cones and waffle cones typically have pointed bottoms, the waffle cones having a gentler slope than sugar cones.

When one obtains a cone loaded with ice cream, the ice cream begins to melt immediately. The melt rate increases with ambient temperature, as well as with wind speed, and can get to a point that the purchaser can not prevent dripping of melted ice cream onto clothes, hands, and other surfaces, as well as runoff of melt onto the hand holding the cone and the cone itself. To combat drippings and runoff, many people wrap cones in napkins or use paper sleeves. However, the napkins and sleeves only absorb runoff and do little, if anything, to prevent dripping.

Two types of ice cream cone holder were introduced, as disclosed in U.S. Design Pat. Nos. D382,085 and D391,036, that not only acted as sleeves about cones, but included disc portions to capture drippings. The disc portions included a rim to keep captured drippings and runoff on the disc portion, enabling the capture of substantial quantities of runoff and drippings before leaking over the rim. However, in extreme cases, the melted ice cream would leak over the rim, dripping onto clothes, skin, and other surfaces.

In addition, when manufactured as disclosed in U.S. Design Pat. Nos. D382,085 and D391,036, the holders had a tendency to stick together when stacked. Thus, when an end holder was grasped and pulled, a vacuum would form, dragging one or more additional holders with the one desired.

Embodiments contemplate improved cone holders that include de-nesting formations to reduce or eliminate vacuum formation between stacked holders. Additionally, embodiments contemplate the addition of a lip around the inner periphery of the disc portion of the holders to help prevent entry of melt into the conical portion of the holders. Further, embodiments contemplate the inclusion of at least one drainage formation in the lip about the inner rim, the rim and at least one drainage formation being sized such that melt will enter the conical portion before spilling over the rim on the outer periphery of the disc portion.

DESCRIPTION

Figure 1:
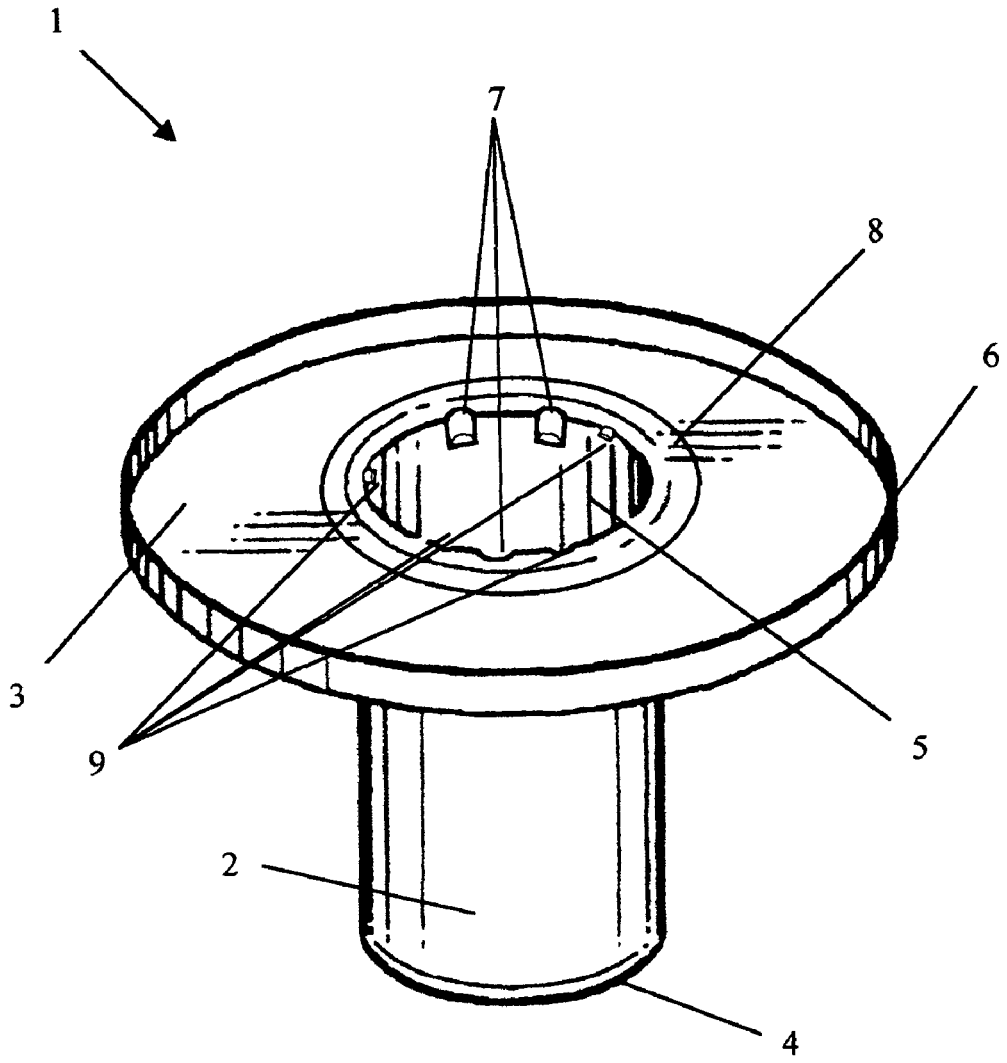
FIG. 1 is a schematic elevational view of the holder of embodiments in which the conical portion is a substantially cylindrical frustroconical formation.
Figure 2:
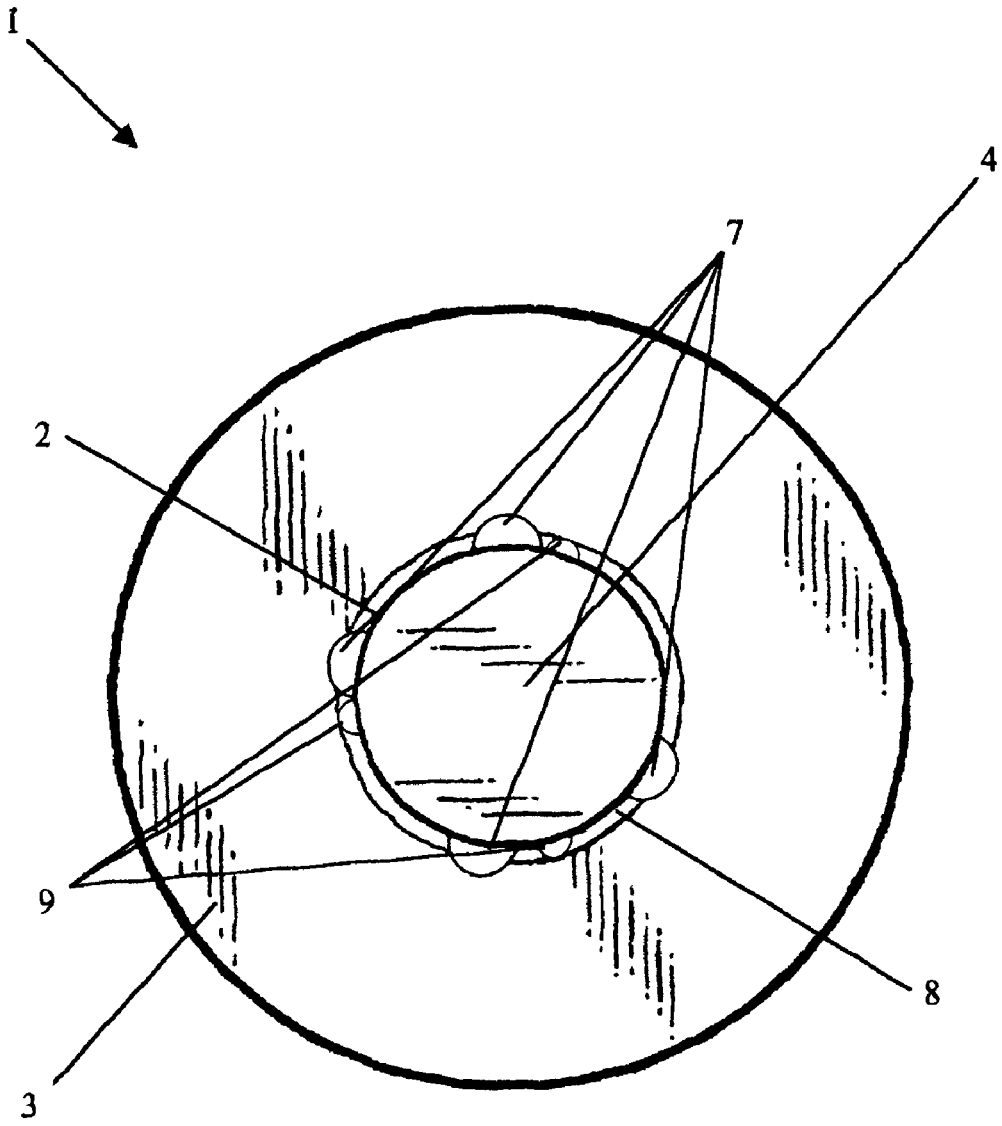
FIG. 2 is a schematic view of the apparatus of embodiments from the closed end of its conical portion.
Figure 3:
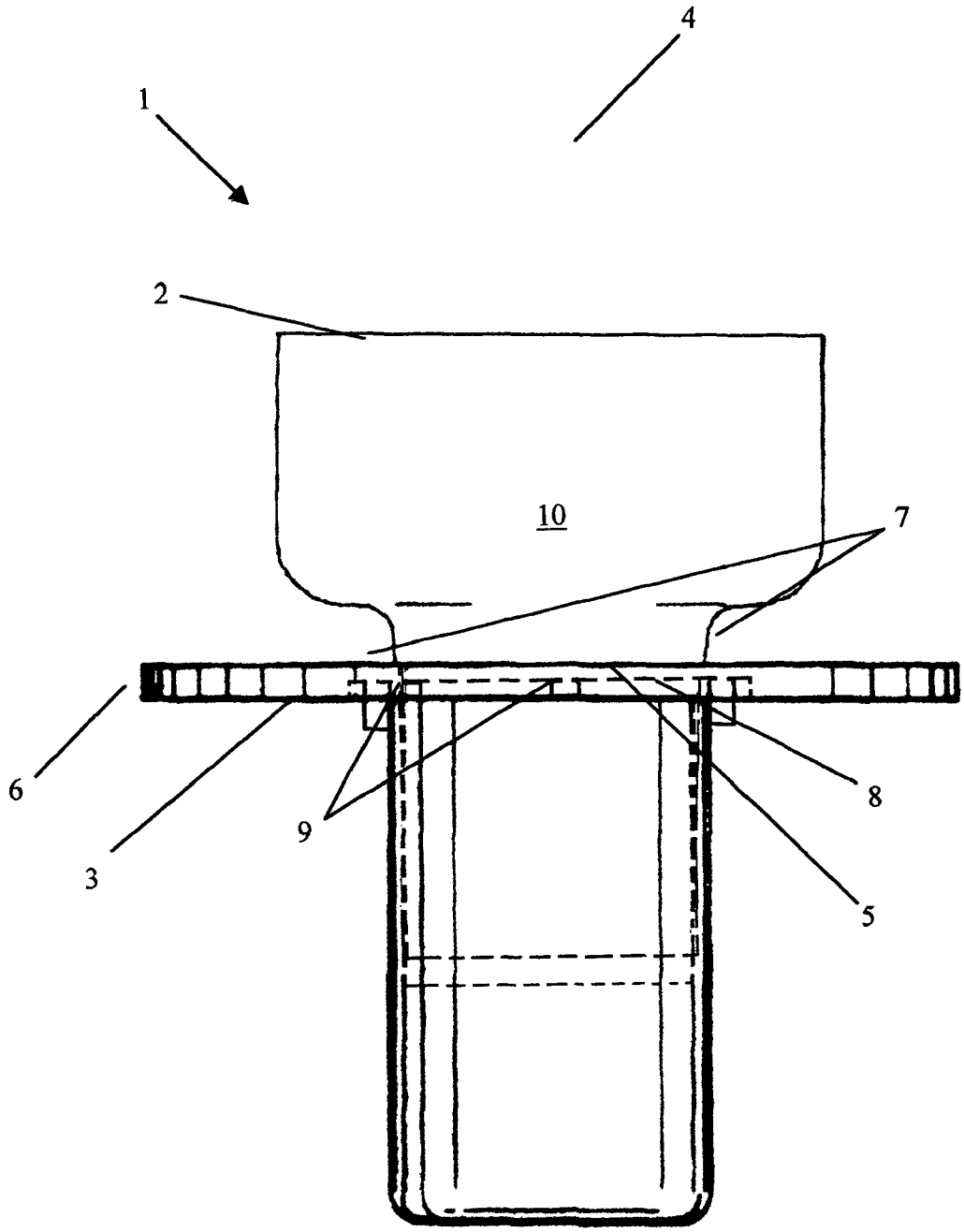
FIG. 3 is a schematic view of the apparatus of embodiments receiving an ice cream cone, such as a flat-ended wafer cone, according to embodiments.
Figure 4:
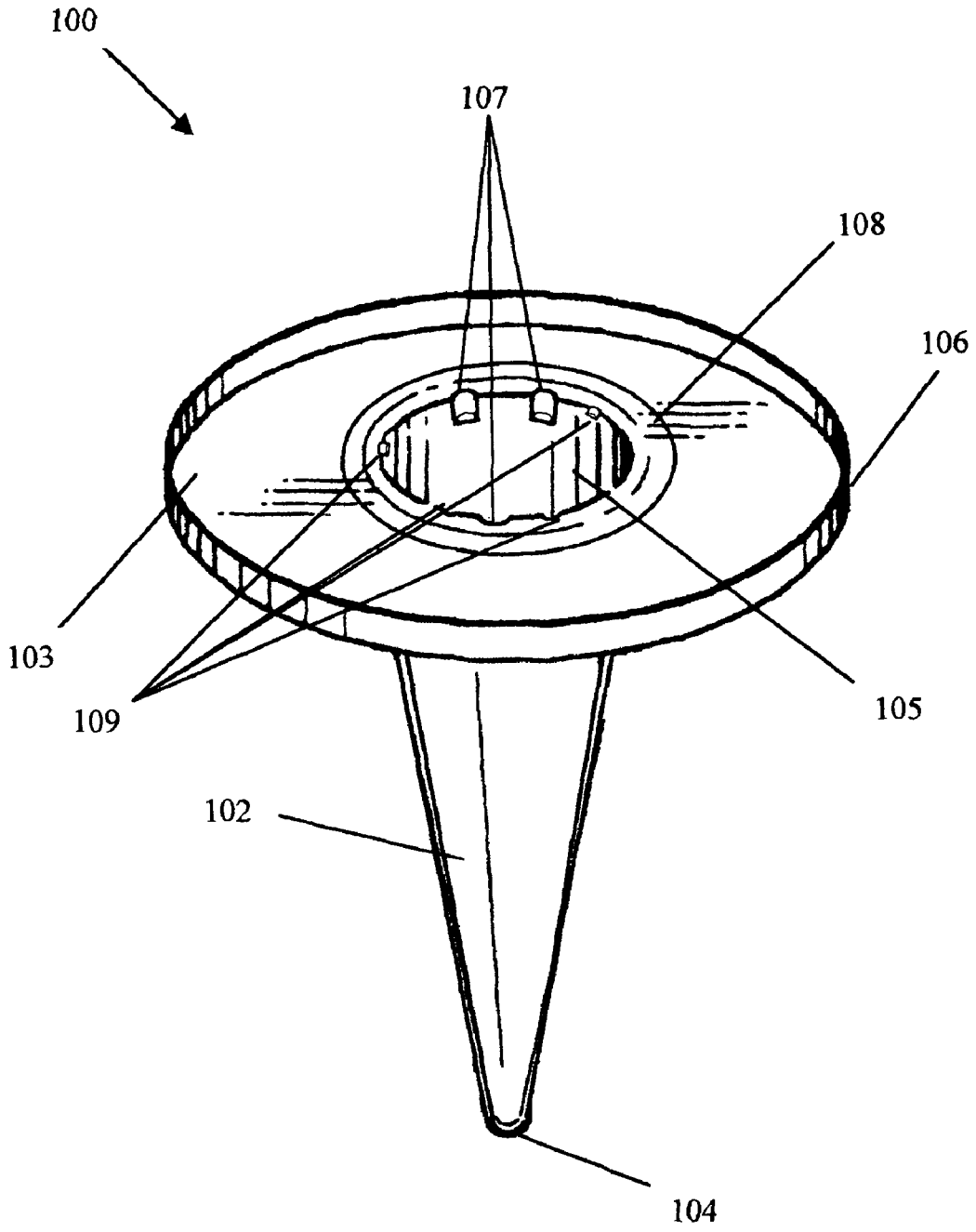
FIG. 4 is a schematic elevational view of the apparatus of embodiments in which the conical portion is more apparently conical.

Embodiments contemplate an improved apparatus such as that disclosed in U.S. Design Pat. Nos. D382,085 and D391,036. With reference to FIGS. 1-3, an embodiment of the apparatus 1 is an ice cream cone holder comprising a conical portion 2 and a disc portion 3 and particularly suited to holding flat-ended wafer cones. The conical portion 2 is frustroconical with a closed end 4 and an open end 5. The side walls of the conical portion 2 have a steep slope relative to the disc portion 3 such that the conical portion appears to be substantially cylindrical. Further, the closed end 4 is substantially parallel to a surface of the disc portion 3, is substantially flat, and is substantially circular.

The disc portion 3 is formed about the open end 5 of the conical portion 2 and includes a rim 6 about its outer periphery to prevent spillage of ice cream drippings captured by the disc portion 3. About the open end 5, a plurality of de-nesting notches 7 are formed, preferably in varying patterns from one holder to the next, to prevent stacked apparatus from sticking together by vacuum formation, static electricity, and the like, when one on an end of a stack is removed. A lip 8 is formed in the disc portion 3 around the open end 5 to help keep drippings and other forms of melted ice cream in the disc portion 3. However, for extreme melt capture, it is preferable to have drippings enter the conical portion 2 rather than spill over the rim 6, so at least one drainage notch 9 is included in the lip 8 to allow melt to enter the conical portion 2 when the disc portion 3 is full. Preferably, the apparatus 1 is a single piece of material, such as plastic or paperboard. The holder is sized to accommodate cones that are common on the market. For example, an effective conical portion can have a length of from about 1 to about 1.5 times the diameter of the open end and a closed end of substantially flat, circular form with a diameter of from about 0.75 to about 0.9 times the diameter of the open end.

Figure 5:
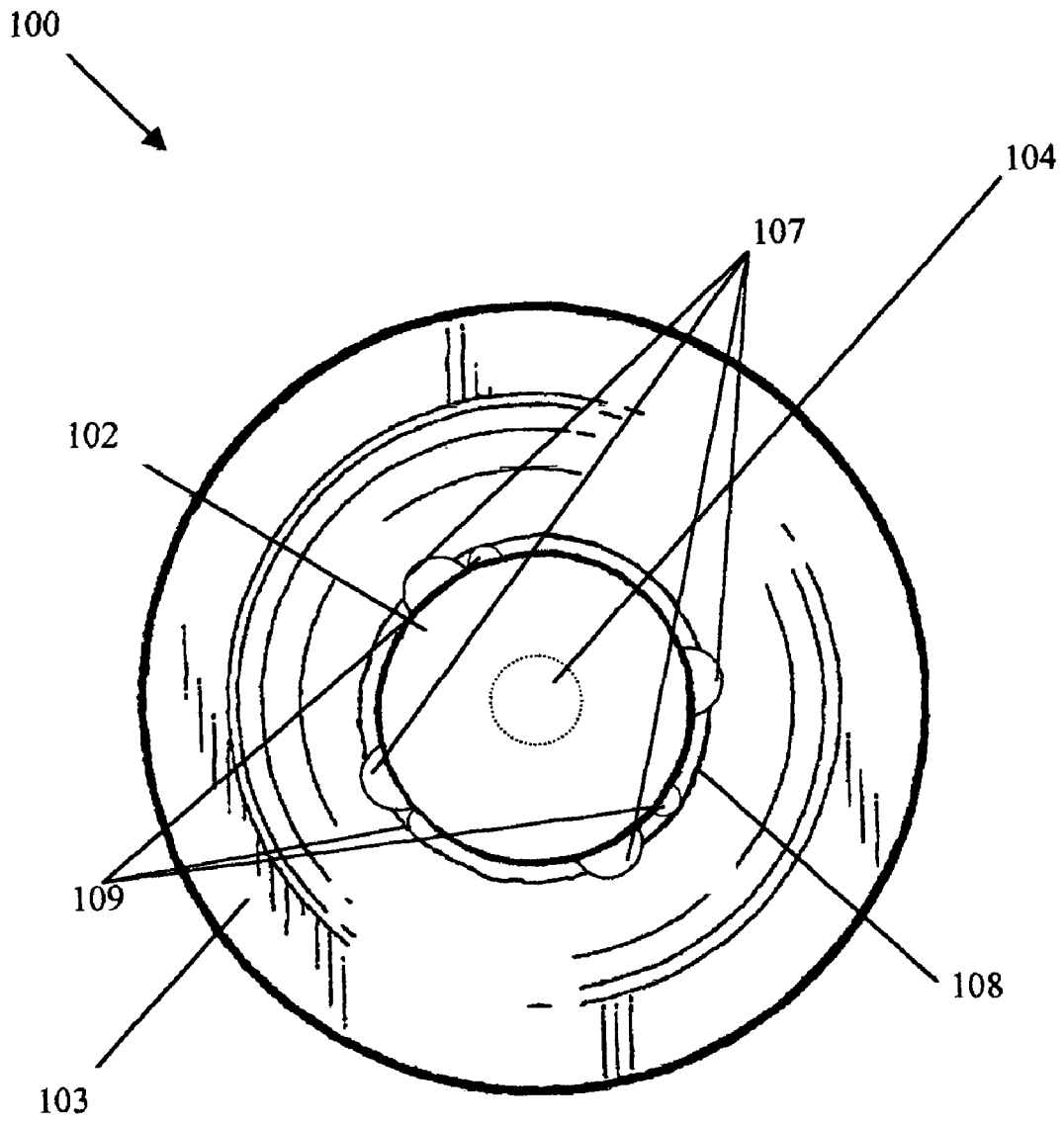
FIG. 5 is a schematic view of the apparatus of embodiments from the closed end of its conical portion.
Figure 6:
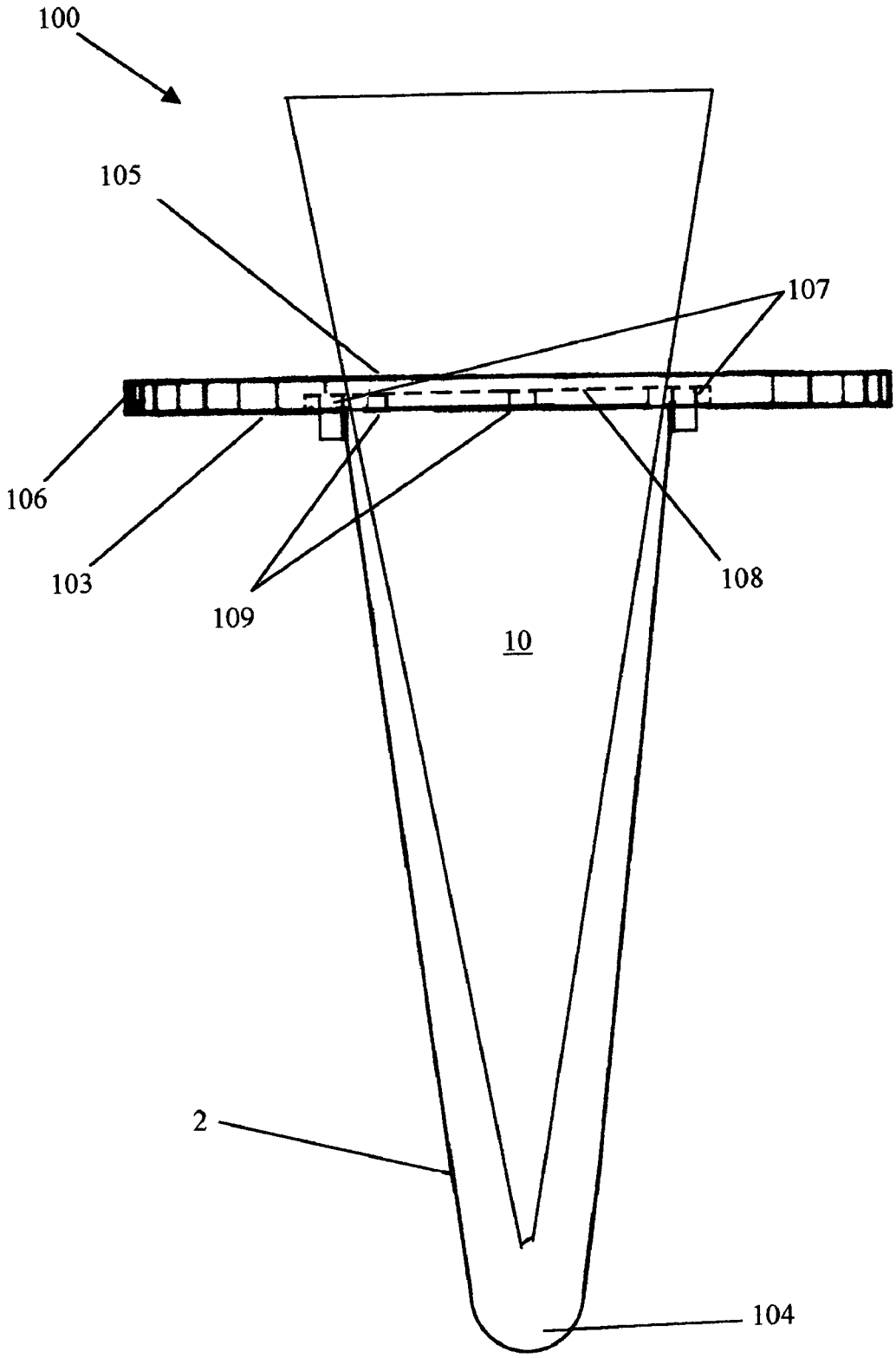
FIG. 6 is a schematic view of the apparatus of embodiments receiving and ice cream cone, such as a sugar cone or waffle cone, according to embodiments.
Figure 7:
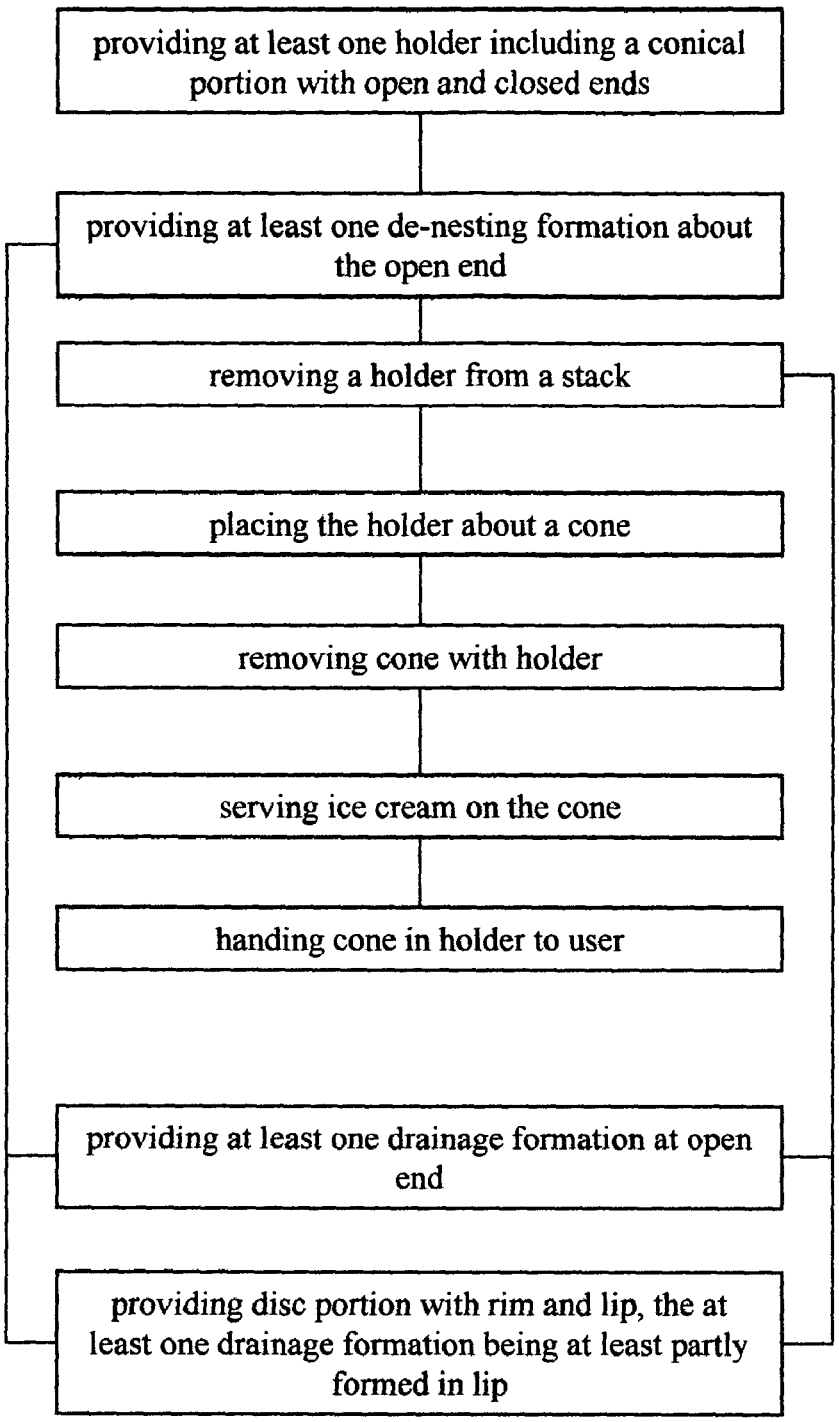
FIG. 7 is a schematic flow diagram of the method of embodiments.

FIGS. 5-6 show another embodiment of the apparatus 100, also an ice cream cone holder, comprising a substantially conical portion 102 and a disc portion 103. Here, the conical nature of the conical portion 102 is much more pronounced and noticeable than in the apparatus of FIGS. 1-3, the holder 100 being more suited for use with conical sugar and waffle cones. As with the wafer cone embodiment, the conical portion 102 is closed at one end 104 and open at the other 105, but in this case the closed end 104 is preferably substantially hemispherical. Other forms of the closed end 104 are contemplated, including flat circular and pointed ends, but the hemispherical form is preferred for manufacturing and other reasons.

The disc portion 103 is formed about the open end 105 of the conical portion 102 and includes a rim 106 about its periphery to prevent spillage of ice cream drippings and other melt captured by the disc portion 103. About the open end 105, a plurality of de-nesting notches 107 are formed, preferably in varying patterns from one holder to the next, to prevent stacked apparatus 100 from sticking together by vacuum formation, static electricity, and the like, when one on an end of a stack is removed. A lip 108 is preferably formed in the disc portion 103 around the open end 105 to help keep melt in the disc portion 103, thus avoiding soaking the ice cream cone contained therein. However, for extreme melt capture, it is preferable to have drippings enter the conical portion rather than spill over the rim 106, so at least one drainage notch 109 is included in the lip 108 to allow drippings to enter the conical portion 102 when the disc portion 103 is full Preferably, the apparatus 100 is a single piece of material, such as plastic or paperboard. This form of the holder is preferably designed to accommodate the cones prevalent on the market. For example, an effective conical portion can have a length of from about 2 to about 3 times the diameter of the open end and can have a substantially hemispherical closed end with a diameter of from about 0.25 to about 0.5 times the diameter of the open end.

In use, one places the open end 5, 105 over an ice cream cone such that the conical portion 2, 102 surrounds the body of the cone. The holder acts as a sleeve about the cone so that a user need not worry about soiling the cone or vice versa. In an ice cream parlor or the like, stacks of the holders can be kept for easy access. The vendor grasps the end holder, pulls it off the stack, and places it on the end cone in a stack of ice cream cones. Using the holder in this manner adds an extra layer of hygiene to the ice cream serving process, preventing contamination of the cone from the vendor's hands, gloved or not. The vendor then holds the ice cream cone through the holder and serves ice cream. In such a configuration, melting ice cream, such as drippings and runoff, can collect on and in the disc portion 3, 103, preventing drips onto floors, clothes, shoes, skin, and other surfaces upon which drips would be undesirable, in addition to containing runoff and other melt.

It will be appreciated that various of the above-disclosed and other features and functions, or alternatives thereof, may be desirably combined into many other different systems or applications. Additionally, various presently unforeseen or unanticipated alternatives, modifications, variations or improvements therein may be subsequently made by those skilled in the art which are also intended to be encompassed by the following claims.

What is claimed is:

1. An improved ice cream cone holder system, comprising:

a plurality of stacked cone holders, each having a conical portion with an open end and a closed end configured to fit around an ice cream cone;

wherein each of said plurality of stacked cone holders has a disc portion formed about the open end including a rim about its outer periphery, the disc portion being substantially planar and substantially perpendicular to a longitudinal axis of the conical portion;

wherein each of said plurality of stacked cone holders has a plurality of drainage formations adjacent a juncture of the conical portion and the disc portion, the drainage formations being configured such that liquid collecting on the disc portion will pass through the at least one drainage formation before it can spill over the rim; and wherein a distribution pattern of the drainage formations varies from one holder to another holder in said stack to prevent sticking.

2. The holder system of claim 1 wherein each said conical portions has hollow de-nesting formations about its open end, the de-nesting formations being configured to inhibit vacuum formation between stacked holders; and wherein a distribution pattern of the de-nesting formations varies from one holder to another holder in said stack to prevent sticking.

3. The holder system of claim 1 further comprising a lip of the disc portion about the open end of the conical portion.

4. The holder system of claim 3 wherein the de-nesting formations are formed at least partly in the lip.

5. An improved ice cream cone holder system, comprising:

plurality of stacked cone holders, each having a conical portion with an open end and a closed end;

wherein each said plurality of stacked cone holders has a disc portion formed about the open end, the disc portion being substantially planar and substantially perpendicular to a longitudinal axis of the conical portion;

wherein each said plurality of stacked cone holders has a rim formed on an outer periphery of the disc portion and projecting away from the open end of the conical portion and substantially parallel to the longitudinal axis of the conical portion;

wherein each said plurality of stacked cone holders has at least one drainage formation adjacent a juncture of the conical portion and the disc portion, the at least one drainage formation being configured such that liquid collecting on the disc portion will pass through the at least one drainage formation before it can spill over the rim;

wherein each said plurality of stacked cone holders has hollow de-nesting formations about the open end of the conical portion, the de-nesting formations being configured to inhibit vacuum formation between stacked holders;

wherein a distribution pattern of the de-nesting formations varies from one holder to another holder in said stack to prevent sticking; and wherein a distribution pattern of the drainage formations varies from one holder to another holder in said stack to prevent sticking.

6. The holder system of claim 5 further comprising a lip formed on the disc portion about the juncture of the conical and disc portions to inhibit entry of liquid collecting on the disc portion.

7. The holder system of claim 6 wherein the at least one drainage formation is in the lip.

8. A method of using an ice cream cone holder system, comprising providing at least one holder by:

providing a plurality of stacked cone holders, each having a conical portion with an open end and a closed end configured to fit around an ice cream cone; and providing each said conical portion with hollow de-nesting formations about the open end of its conical portion, the de-nesting formations being configured to inhibit vacuum formation between stacked holders;

providing that a distribution pattern of the de-nesting formations varies from one holder to another holder in a said plurality of stacked holders to prevent sticking;

providing each said cone holders has a disc portion formed about the open end, the disc portion being substantially planar and substantially perpendicular to a longitudinal axis of the conical portion;

providing each said cone holders has a plurality of drainage formations adjacent a juncture of the conical portion and the disc portion, the drainage formations being configured such that liquid collecting on the disc portion will pass through the at least one drainage formation before it can spill over the rim;

providing that a distribution pattern of the drainage formations varies from one holder to another holder in said stack to prevent sticking;

removing a holder from a said plurality of stacked holders, the de-nesting formations inhibiting vacuum formation between the holder and the slack;

placing the holder about a cone;

removing the cone with the holder;

servicing ice cream on the cone; and handing the cone in the holder to a customer.

9. The method of claim 8 further comprising keeping the holder on the cone while eating the ice cream, the disc portion and rim portion cooperating to contain ice cream melt.

10. The method of claim 9 further comprising allowing melt to enter the conical portion through the at least one drainage formation.

11. The method of claim 10 wherein providing at least one holder further comprises providing a lip about an inner periphery of the disc portion at each said open end of the conical portion, forming the at least one drainage formation and the at least one de-nesting formation at least partly in the lip, and varying a distribution pattern of the at least one drainage formation from holder to holder.

12. The method of claim 8 wherein providing at least one holder includes providing each said conical portion with a length of from about 2 to about 3 times a diameter of the open end.

13. The method of claim 8 wherein providing at least one holder includes providing each said conical portion with a length of from about 1 to about 1.5 times a diameter of the open end.

14. The method of claim 9 wherein providing at least one holder includes providing each said closed end with substantially hemispherical form and with a diameter of from about 0.25 to about 0.5 times a diameter of the open end.

15. The method of claim 8 wherein providing at least one holder includes providing each said closed end with substantially flat, circular form and with a diameter of from about 0.75 to about 0.9 times a diameter of the open end.

* * * * *